United States Patent [19]

Ritchey et al.

[11] Patent Number: 4,688,963

[45] Date of Patent: Aug. 25, 1987

[54] DOWEL BAR PLACING

[75] Inventors: Paul E. Ritchey, West Allis; Joseph L. Jarboe, Richfield, both of Wis.

[73] Assignee: Rexworks Inc., Milwaukee, Wis.

[21] Appl. No.: 854,014

[22] Filed: Apr. 21, 1986

[51] Int. Cl.[4] ..... E01C 23/02; E01C 3/06; E01C 7/28; E01C 11/24

[52] U.S. Cl. ..... 404/72; 404/88

[58] Field of Search ..... 404/51, 52, 61–63, 404/72, 87, 88, 100, 114, 118

[56] References Cited

U.S. PATENT DOCUMENTS

| | | | |
|---|---|---|---|
| 2,389,773 | 11/1945 | Golden | 404/88 |
| 2,654,297 | 10/1953 | Nettleton | 404/52 |
| 3,068,766 | 12/1962 | Houck | 404/88 |
| 3,491,661 | 1/1970 | Hudis | 404/87 |
| 3,530,776 | 9/1970 | Hudis | 404/87 |
| 3,876,323 | 4/1975 | Williams | 404/87 |
| 4,136,993 | 1/1979 | Fletcher | 404/88 |
| 4,433,936 | 2/1984 | Moser | 404/88 |
| 4,493,584 | 1/1985 | Guntert | 404/88 X |

FOREIGN PATENT DOCUMENTS 205063 9/1959 Austria .

OTHER PUBLICATIONS

Western Construction (Mar. 1960).

*Primary Examiner*—Charlie T. Moon
*Attorney, Agent, or Firm*—George A. Evans, Sr.

[57] ABSTRACT

An attachment to a slipform paver is provided which has side plates and surface plates engaging the sides and top surface respectively of a freshly formed slab of concrete, the slide plates being movable laterally to conform to deviations in the direction of the path of the concrete slab and the surface plate inclining upwardly toward the slab edge to maintain the slab contour during insertion of the dowel bars through the side plate into the side edge of the slab.

8 Claims, 2 Drawing Figures

DOWEL BAR PLACING

BACKGROUND OF THE INVENTION

Adjacent slabs of concrete are commonly connected by dowel bars, the ends of which are inserted in the side edge of a freshly poured strethc of concrete. The other extending ends of the dowels become embedded in the adjacent slap of concrete when it is poured. When the concrete sets, the adjacent portions, although poured at different times, are firmly bound together assuming the bars are properly spaced apart. In one particular job, where runways at an airport were being laid, the dowels were twenty inches long, with half the length in each of the adjacent concrete slabs. The dowels were inserted in the middle of the thickness of the slab. The dowels were one and a quarter inches in diameter and spaced about 15 inches apart. The concrete has to be very stiff to prevent the dowels from sagging prior to setting of the concrete. Once the concrete has set, the dowels remain in fixed position when the adjacent lane is poured.

It is an object of the present invention to mechanize the insertion of the dowels while confining the top and side surfaces of the slab during this operation and preventing the side retaining plates from digging into the slab should the course of the slab deviate from a straight direction.

It is common practice to establish concrete pavement slabs by using slipform pavers. These are self propelled machines having spaced vertical side forms and a screed sometimes called an extrusion meter extending between the side forms. The extrusion meter is supported by the frame and screeds the concrete deposited on the road bed ahead of the advancing machine. The pressure exerted by the side forms and the extrusion meter is sufficient so that the contour of the slab is retained as the machine moves ahead and loses contact therewith. It is into such a slab that the dowels are inserted. When an adjoining slab is formcd, one side of the slipform paver is elevated and runs on the original slab which has now firmly set, while the other side of the paver travels on the prepared grade. The two slabs are firmly connected by the embedded dowel bars.

SUMMARY OF THE INVENTION

Extending across the initial slab immediately behind the slipform paver to which it is connected is a cross member of rigid construction. Depending from each end of the cross member are side plates which abut the sides of the slab. These plates are of a height at least equal to the thickness of the slab so that the lower edges contact the ground. The central portion of the plate is provided with a slot extending forward from the rear edge to about the middle of the plate. The slot is just wide enough to enable a dowel to be inserted through it. The dowel inserting mechanism consists of a pneumatic cylinder and channel mounted on the end of the cross nember so that dowels are held in a position at right angle to the face of the concrete in which they are inserted. The mounting of the cross member permits it to swing laterally should a deviation in the path of the slab occur. Thus prevents the side plates from digging into the slab. In fact, the contour of the slab causes the plates to move sideways so they are always in the proper abutting relationship. The cross member also carries a plate that rests on the surface of the slab above the side portion into which the dowels are inserted. This plate can be deformed so that the end portion can be elevated or tilted upward to confine and shape the surface of the concrete. The pressure exerted is sufficient to prevent the elevation of the concrete to rise because of the displacement of concrete by the dowels.

DETAILED DESCRIPTION OF THE INVENTION

The slipform paver to which the tie bar inserter is appended has the customary spaced crawler tracks 11' on each side and the two slipforms each of which is arranged just inside one of the tracks. An extrusion meter extends over the slab to be formed with its ends supported by the crawlers. Along with the slipforms, the extrusion meter determines the slab contour as is well known.

Figure 1:
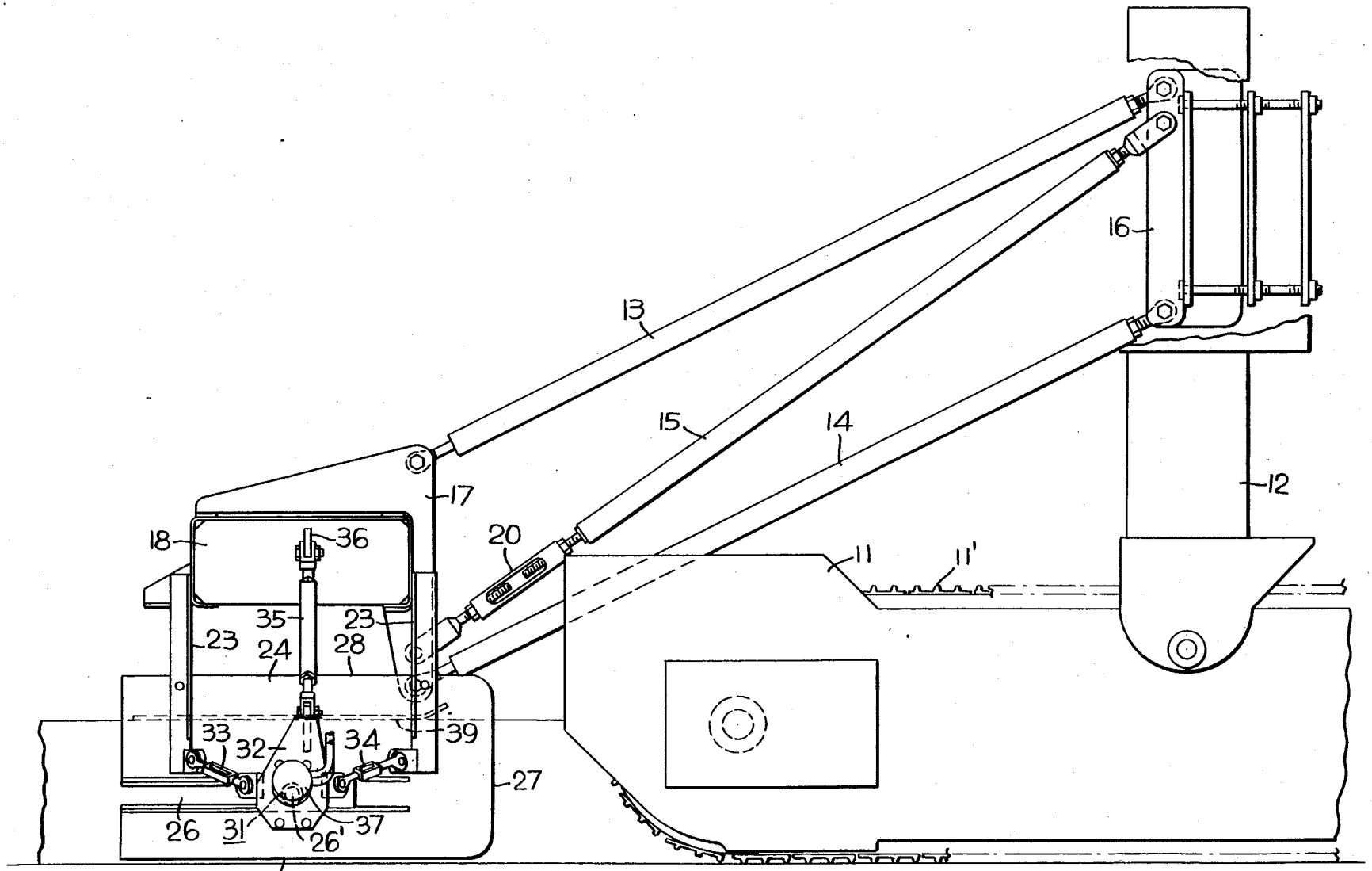
FIG. 1 is a side elevation of the dowel bar placer viewed from one end of the cross member support.

As shown in FIG. 1, the tracks 11' are enclosed in a housing 11 which extends rearwardly on each side from the main frame 12 of the paver. Frame 12 extends all the way across the rear of the paver and has a vertical portion which extends considerably above the crawler housings.

The dowel placer is connected to the main frame by the tie rods or arms 13, 14, and 15 each of which is connected by ball joints at their extremities so as to be capable of universal movement. The rods 13 and 14 are parallel and vertically aligned, with their forward ends supported by the bracket 16 mounted at the rear of main frame 12. The rearward ends of the arms 13 and 14 are connected to the bracket plate 17 which is mounted on a cross member 18, the cross member extending for the full width of the machine. In order to adjust the length of the cross member 18, it is made in two halves with the central ends connected by the turn buckles 19 providing adjustment for the length of the cross member.

The tie rod 15 is for the purpose of supporting the cross member 18 at the proper elevation and includes the turn buckle 20 so as to adjust the length and hence the elevation of the cross member. The ends of the tie rod 15 are connected to the same brackets 16 and 17 as the tie rods 13 and 14.

The method of mounting the cross member is the same at each of its ends, as is the structure mounted on the ends of the cross member. Accordingly only one end is shown in the drawings and will be described in detail.

Figure 2:
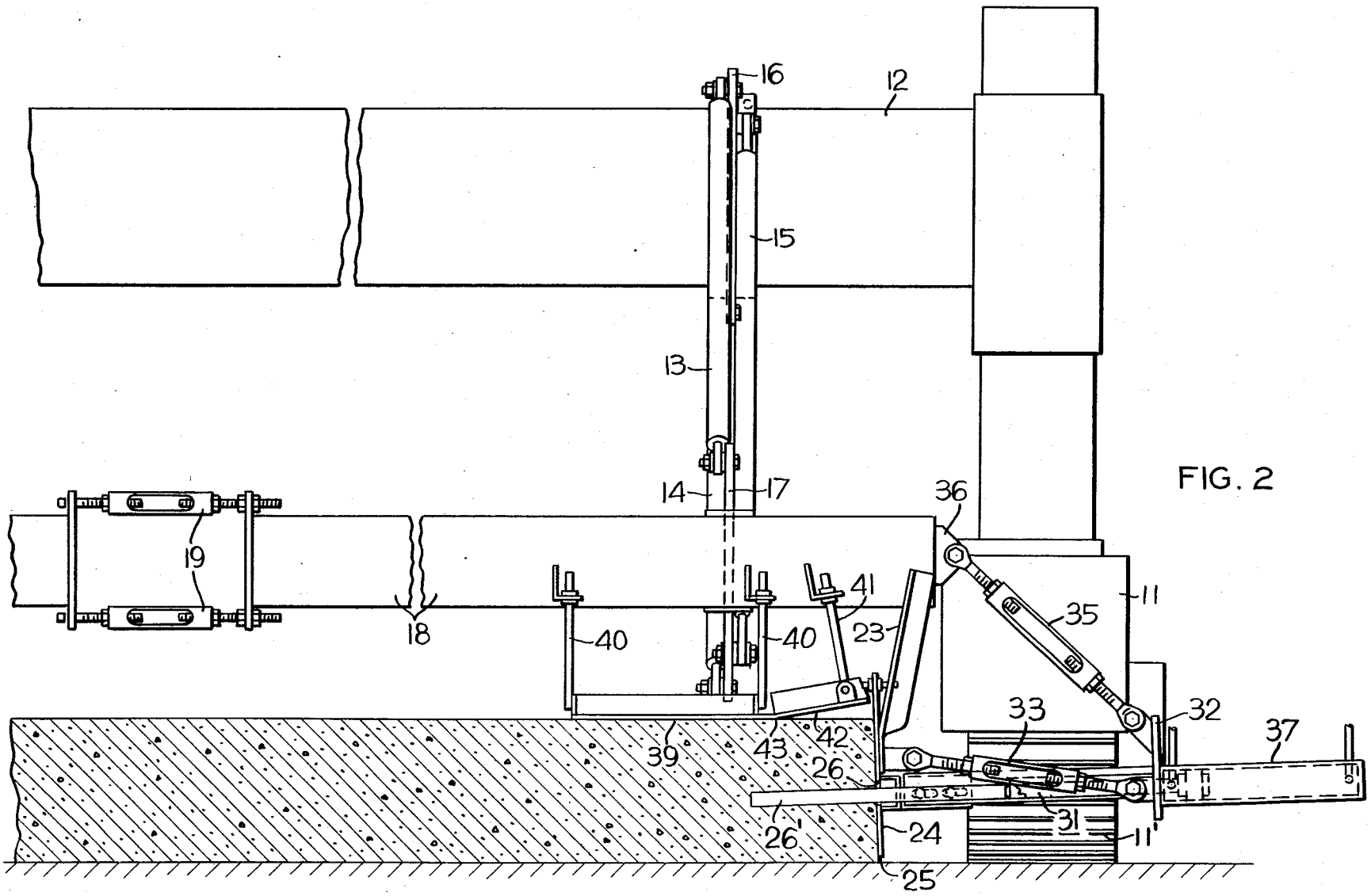
FIG. 2 is a view taken from behind the cross member showing only approximately half of said member.

Depending from the front and rear sides of the cross member are brackets 23 on which a side plate 24 is bolted. Side plate 24 has a bottom edge 25 disposed slightly above ground level and a slot 26 extending from the rear edge of the plate forward to approximately the center thereof. The width of slot 26 is greater than the diameter of the dowel bar 26', which is shown inserted into the freshly laid slab of concrete. The front edge 27 of the plate 24 is curved outwardly to afford a slight clearance with the preformed slab which extends rearwardly from the paver. The top 28 of the plate 24 extends somewhat above the top of the slab. As shown in FIG. 2, plate 24 is adjustable from sloping slightly inwardly toward the top to a vertical position to conform to the top edges of the concrete slab.

The dowel inserter consists of the fixture 31 which is open at the top so that a dowel can be placed and fitted within it in alignment with the slot 26 in the plate 24. The fixture is trough shaped with its long section at right angles to the plate 24 and the side of the slab which the plate 24 abuts. The outer end of the fixture 31 is supported by a vertical plate or bracket 32 which is supported by the tie rods 33, 34 and 35. The inner ends of rods 33 and 34 are secured to brackets 23, while the middle rod 25 is secured to a plate 36 on the end of the cross member 18. Also mounted on bracket 32 is the cylinder 37 which may be pneumatic or hydraulic and which is aligned with the open end of the fixture 31 so that the piston mounted in the cylinder has a stroke that extends into the fixture and drives the dowel through the slot 26 and embeds it in the side of the concrete slab.

The stroke of the piston causes a substantial portion of the length of the dowel bar to be inserted into the slab. Upon retraction of the cylinder, a subsequent bar is placed in the fixture 31 and is in turn inserted in the slab. The interval of time between the strokes of the piston is controlled by the operator so that the dowels are spaced the proper distance apart.

Instead of manually placing the dowels in the fixture 31, they may be mechanically fed from a magazine in which they are verically stacked and dropped one at a time.

Another feature of the invention is the provision of the surface plate 39 that extends from the outer edge of the slab a short distance inwardly. As shown in FIG. 2, this plate is about as wide as the length of the side plate 24. Plate 39 is supported by a number of tie rods; the inner tie rods 40 support the inner portion so it is approximately horizontal, while the tie rods 41 are adjustable to elevate the outer portion 42 so that the outer edge of the outer portion is slightly eleveated with respect to the rest of the plate. Actually the plate 39 may be made in one piece, but with a line of weakness as at 43 so it can be bent to the desired contour.

By providing an extrusion plate 39 the outer portion of which slopes upward to the edge of the slab, the slab may be maintained with an outer top surface that is slightly elevated, the same as it is when it leaves the slipform paver. What the plate 39 does is to keep this portion of the concrete from being elevated due to the displacement of concrete by the dowels. At the same time the side edge of the slab is maintained in the proper contour by the side plate 24 as previously described.

Since similar plates 24 are provided at each end of the cross member 18 in closely abutting relation to the slab, and since the cross member is mounted on the paver by the links that permit it to move sideways, deviation in the direction of the slab from a straight path will cause the attachment to move with the slab deviation in a lateral direction. This prevents the side plates from digging into the slab, the plates being turned on a radius less than the turning radius of the paver and independent of the steering of the paver. At the same time, the side plate adjacent the pneumatic installer cooperates with the surface pan to maintain the proper edge of the slab as the dowels are inserted.

It is possible to simultaneously install dowels on each side of the pavement slab in which case similar inserting mechanism is provided at each end of the cross member. If dowels are inserted in only one edge, the surface plate 39 can be eliminated at the other end of the cross member since the original surface contour is not disturbed.

While the invention has been described in connection with the inserter of dowel bars, it will be understood that the apparatus and method may be used to insert tie bars and other embedded items serving a similar purpose.

The invention having been described, what is claimed is:

1. A dowel bar inserter for inserting dowel bars in the side face of a concrete slab freshly formed by a slipform paver, said inserter comprising a cross member, side face members having rearwardly opon slots therein, mounted on the ends of the cross member, means supporting the cross member from the rear of the paver including parallel links connecting the cross member with the rear of the paver, said links permitting the cross member and the side face members to move laterally as a result of deviations in the course of the pavement slab, and means for inserting dowels through said slots in said side face members and into the side faces of said slab.

2. Apparatus as set forth in claim 1 including a set of parallel links adjacent each end of the cross member and locking rods adjacent each set of parallel links for controlling the elevation of each end of the cross member each of said rods and links having universal connections at their ends enabling the cross member to move sidewise under the influence of contact between the side faces and the slab.

3. Apparatus as set forth in claim 1 including an extrusion plate supported from the end of cross member, said plate having an outer section that can be tilted upwardly toward the edge of the slab to define the top surface of the slab on which the section rests, and means for adjusting the amount of tilt of said section.

4. Apparatus as set forth in claim 3, in which the extrusion section has a line of weakness parallel to the adjacent side face member, said line being a distance from the side face to maintain the elevation of the slab sustantailly unchanged from that which leaves the extrusion meter of the paver.

5. Dowel placing apparatus for a slipform paver comprising a support mounted on the rear of the paver, a fixture having an open upper surface set at right angles to and connected to each end of said support rearwardly of a side form of said paver, the inner end of the fixture being adjacent the edge of the slab, a pneumatic piston for forcing dowels disposed in the fixture into the concrete slab side face to a pre-determined depth and means also carried by said support engaging the top surface of the slab in the area of the penetration of the dowels to prevent upward movement of said surface caused by concrete displaced by the dowels.

6. In a method of inserting dowel bars in the side of a slab of concrete laid by a traveling slipform paver, the steps of supporting a cross member from the rear of the paver, said cross member having at each end rearwardly open slotted side plates, pressing dowels into said slotted side plates and slab side faces at right angles to the side face of the slab during the forward progress of the paver, the improvement which comprises rigidly controlling the elevation of the cross member from the elevation of the paver while permitting lateral movement thereof, and relying on the side deflection of the slab to cause the side plates to maintain a closely juxtaposed relation to the slab whereby interference between said faces is avoided.

7. The method as set forth in claim 6, which includes simultaneously pressing down on the top surface of the end position of the slab to overcome the tendency of the surface of the slab to rise due to the displacement of the concrete by the insertion of the dowels.

8. A dowel bar inserter for inserting dowel bars into the side faces of a concrete slab freshly formed by a slipform paver, comprising a side form member arranged to engage the side face of the slab as it leaves the rear side form of the paver, a slot extending forwardly from the rear end of said member disposed to straddle the exposed end of a dowel after it is inserted into the side face of the slab, means for inserting a dowel through said slot into the side face of the slab, and means supporting said side form member from the rear of the paver and permitting lateral movement to follow deviations in the path of the slab while maintaining contact between the face of the member and the face of the slab.

* * * * *